US008174476B2

(12) United States Patent
Jo

(10) Patent No.: US 8,174,476 B2
(45) Date of Patent: May 8, 2012

(54) DISPLAY DEVICE

(75) Inventor: Jo-yeon Jo, Asan-si (KR)

(73) Assignee: Samsung Electronics Co., Ltd. (KR)

( * ) Notice: Subject to any disclaimer, the term of this patent is extended or adjusted under 35 U.S.C. 154(b) by 940 days.

(21) Appl. No.: 12/217,373

(22) Filed: Jul. 2, 2008

(65) Prior Publication Data

US 2009/0121997 A1 May 14, 2009

(30) Foreign Application Priority Data

Nov. 14, 2007 (KR) ..... 10-2007-0116067

(51) Int. Cl.
*G09G 3/36* (2006.01)

(52) U.S. Cl. ..... 345/99; 345/98; 345/204; 345/211; 345/214; 257/298

(58) Field of Classification Search ..... 345/99, 345/204, 211–214; 257/298; 348/725, 714, 348/718, 730, 836, 552; 439/497
See application file for complete search history.

(56) References Cited

U.S. PATENT DOCUMENTS

| | | | | |
|---|---|---|---|---|
| 2003/0112376 | A1* | 6/2003 | Schnellenberger | 348/725 |
| 2004/0052109 | A1* | 3/2004 | Geren et al. | 365/185.01 |
| 2006/0001822 | A1* | 1/2006 | Sano | 349/150 |
| 2007/0109855 | A1* | 5/2007 | Donderer | 365/185.08 |

FOREIGN PATENT DOCUMENTS

| | | | |
|---|---|---|---|
| CN | 1758324 | A | 4/2006 |
| WO | 03/055204 | A1 | 7/2003 |

* cited by examiner

*Primary Examiner* — Lun-Yi Lao
*Assistant Examiner* — Priyank Shah
(74) *Attorney, Agent, or Firm* — Innovation Counsel LLP

(57) ABSTRACT

In accordance with one or more embodiments of the present invention, a display device includes a timing controller that generates a control signal and a data signal for displaying an image, a memory that records the data signal, and an $I^2C$ bus that connects the timing controller and the memory element. The $I^2C$ bus includes a serial clock line and a serial data line, which respectively comprise a first end part that is connected with the memory and a second end part that is connected with the timing controller. The $I^2C$ bus includes first and second decoupling capacitors that are respectively connected to the serial clock line and the serial data line. A connection distance of the interface between the timing controller and the memory has a minimum distance.

13 Claims, 5 Drawing Sheets

DISPLAY DEVICE

CROSS-REFERENCE TO RELATED APPLICATION

This application claims priority to and the benefit of Korean Patent Application No. 10-2007-0116067, filed on Nov. 14, 2007, in the Korean Intellectual Property Office, the disclosure of which is incorporated herein by reference in its entirety.

BACKGROUND

1. Field of the Invention

The present invention relates to a display device, and more particularly, to a display device that reduces deterioration due to electrostatic discharge (ESD) or external noise.

2. Description of the Related Art

There are various types of display devices. Among these, a liquid crystal display (LCD) having good performance, a small size and a light weight has been widely used.

The LCD has been applied to large sized products, including monitors and televisions as well as small sized products including mobile phones, personal digital assistants (PDA), and portable multimedia players (PMP), which have a display for viewing by a user. That is, the LCD has been applied to many information processing devices needing a display.

A liquid crystal panel of the LCD includes a display panel and a driving circuit unit.

The display panel includes a plurality of gate lines, a plurality of data lines, and a plurality of pixels connected with the gate lines and the data lines.

The driving circuit unit controls the display panels to display an image. The driving circuit unit includes a timing controller, which generates gate control signals, data control signals, and image signals based on control signals and input image signals from an external, a gate driver, which controls the gate lines based on the gate control signals, and a data driver, which generating data voltages corresponding to image signals from the timing controller in accordance the data control signals to output the data voltages to the pixels.

The driving circuit unit may further includes a memory storing color compensation signals for compensating the input image signals using an ACC (adaptive color compensation) method, etc., so as to compensate color of an image.

The memory generally uses a read only memory (ROM), such as an electrically erasable and programmable read only memory (EEPROM). The timing controller and the memory are connected by an interface, such as a generally known I 2C bus.

However, electrostatic discharge (ESD) or external noise has an effect on communication between the timing controller and the memory through the interface between the timing controller and the memory, which can cause malfunction of the timing controller. Accordingly, the quality of the image displayed by the display device can deteriorate due to malfunction of the timing controller.

SUMMARY

One or more embodiments of the present disclosure may be achieved by providing a display device, comprising: a timing controller that generates a control signal and a data signal for displaying an image; a memory element that records the data signal; and an I2C bus that connects the timing controller and the memory element, the I2C bus comprising: a serial clock line (SCL) and a serial data line (SDA) which respectively comprise a first end part that is connected with the memory element, and a second end part that is connected with the timing controller; and first and second decoupling capacitors that are respectively connected to the serial clock line and the serial data line.

In various implementations, the memory element may comprise an electrically erasable and programmable read only memory (EEPROM). The display device may comprise an EEPROM writer that is connected with the EEPROM to store the data signal in the EEPROM. The decoupling capacitors may be respectively connected to the serial clock line and the serial data line to be nearer to the timing controller than the memory element.

In accordance with an embodiment of the present disclosure, the display device may comprise: a driving power line that is connected to the memory element to supply a driving power, a first pull up resistance that is respectively connected with the driving power line and the serial clock line, and a second pull up resistance that is respectively connected with the driving power line and the serial data line.

In accordance with an embodiment of the present disclosure, the display device may comprise: a first driving power line that is connected with the memory element and the serial clock line, and a second driving power line that is connected with the serial data line.

In accordance with an embodiment of the present disclosure, the display device may comprise: a first pull up resistance that is respectively connected with the first driving power line and the serial clock line, and a second pull up resistance that is respectively connected with the second driving power line and the serial data line.

In accordance with an embodiment of the present disclosure, the display device may comprise a zener diode that is connected to the serial data line. The zener diode may comprise a cathode terminal that is connected with the serial data line and an anode terminal that is connected with a grounding terminal (GND). The display device, in one implementation, may comprise a zener diode that is connected to the serial data line.

BRIEF DESCRIPTION OF THE DRAWINGS

These and/or other aspects of the present disclosure will become apparent and more readily appreciated from the following description of the exemplary embodiments, taken in conjunction with the accompanying drawings, in which.

DETAILED DESCRIPTION

Figure 1:
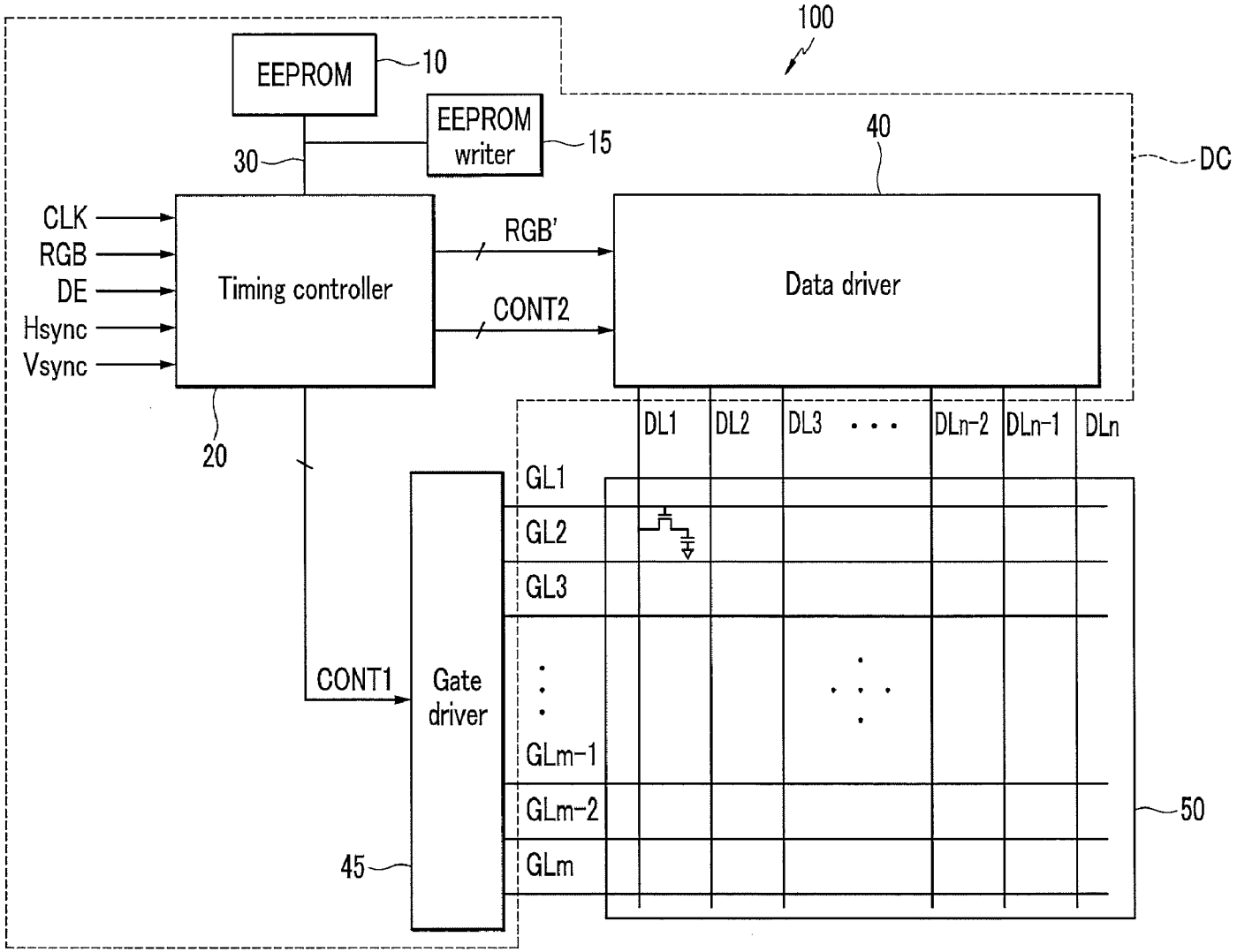
FIG. 1 is a block diagram of a display device according to an exemplary embodiment of the present invention.

Reference will now be made in detail to the embodiments of the present disclosure, examples of which are illustrated in the accompanying drawings, wherein like reference numerals refer to like elements throughout. The exemplary embodiments are described below so as to explain the present disclosure by referring to the figures.

In the accompanying drawings, as an example of a display device, an LCD is illustrated, but the present invention is not limited thereto. Alternatively, the present invention may be applied to an organic light emitting display (OLED), a plasma display device (PDD) and other various display devices.

Hereinafter, an exemplary embodiment of the present invention will be described by referring to FIGS. 1 to 4.

FIG. 1 is a block diagram of a display device according to an exemplary embodiment of the present invention. As shown in FIG. 1, the display device 100 according to an exemplary embodiment of the present invention includes a display panel 50 and a driving circuit unit (DC). The display panel 50 includes a plurality of gate lines GL1-GLm, a plurality of data lines DL1-DLn, a plurality of pixels connected to the gate lines GL1-GLm and the data lines DL1-DLn and a liquid crystal layer including liquid crystal molecules.

Each pixel includes-a switching element, a liquid crystal capacitor connected to the switching element. The pixel may include a storage capacitor connected to the switching element.

The switching element may be a thin film transistors (TFT) having three terminals, i.e., a control terminal connected to a gate line, an input terminal connected to a data line, and an output terminal connected to the liquid crystal and the storage capacitor.

The liquid crystal capacitor includes a pixel electrode (not shown) and a common electrode (not shown) as two terminals. The liquid crystal layer is disposed between the pixel electrode and the common electrode functions as a dielectric of the liquid crystal capacitor. The pixel electrode is connected to the switching element, and the common electrode is supplied with a voltage such as a common voltage.

The display panel 50 displays an image depending on data voltages from the driving circuit unit DC. In FIG. 1, the display panel 50 is illustrated as a liquid crystal panel of a liquid crystal display, but the present invention is not limited thereto.

The driving circuit unit DC includes a data driver 40, a gate driver 45, a timing controller 20 and a memory 10. The driving circuit unit DC includes an interface, for example an $I^2C$ bus 30 connecting the timing controller 20 and the memory 10. In various implementations, the driving circuit unit DC may include a power voltage generating unit, a gray scale voltage generating unit and other necessary elements.

The timing controller 20 uses input control signals from an external to generate gate control signals CONT1 and data control signals CONT2 for driving the gate driver 45 and the data driver 40. The input control signals include a vertical synchronization signal Vsync, a horizontal synchronization signal Hsync, a main clock signal CLK, and a data enable signal DE.

The gate control signals CONT1 include a scanning start signal for instructing to start scanning and at least one a clock signal for controlling the output time of a gate-on voltage. T he gate control signals CONT1 may further include an output enable signal for defining the duration of the gate-on voltage.

The data control signals CONT2 include a horizontal synchronization start signal for informing of start of data transmission for a group of pixels, a load signal for instructing to apply the data voltages to the data lines DL1-DLn, and a data clock signal. The data control signal CONT2 may further include an inversion signal for reversing the polarity of the data voltages with respect to the common voltage.

The timing controller 20 is supplied with input image signals RGB from an external graphics controller (not shown). On the basis of the input control signals, the input image signals RGB, and image compensation signals from the memory, the timing controller 20 processes the input image signals RGB to be suitable for the operation of the display panel 50 and the data driver 40 and output the processed image signals RGB' through the interface to the data driver 40.

The data driver 40 responds to the data control signals CONT2 supplied from the timing controller 20 to select a corresponding data voltage among data voltages for an analog conversion of a digital image signal RGB' and supplies the selected analog data voltage to a corresponding pixel of the display panel 50 to control a rotation angle of the liquid crystal molecules.

The gate driver 45 responds to the gate control signals CONT1 supplied from the timing controller 20, synthesizes the gate-on voltage and a gate-off voltage from an external to generate gate signals for application to the gate lines GL1-GLm. Thereby, the thin film transistors connected to the gate lines GL1-GLm are turned on or off in accordance with the states of the gate signals. The gate lines GL1-GLm on the display panel 50 are enabled by a horizontal synchronization time in sequence to drive the thin film transistors connected to the corresponding gate line GL1-GLm by a 1 line in sequence so that the analog data voltages of one row supplied from the data driver 40 may be applied to the pixel electrodes connected to the respective thin film transistors.

The memory 10 stores data signals such as the image compensation signals. The memory 10 employs a read only memory (ROM), such as an electrically erasable and programmable read only memory (EEPROM). However, the present invention is not limited thereto. Alternatively, the memory 10 may employ other storing elements instead of the EEPROM.

Hereinafter, the memory 10 will be referred to as the EEPROM. The EEPROM 10 is a nonvolatile memory that still stores the stored image compensation signals even though power is turned off, and the EEPROM 10 is capable of electrically erasing and writing again recorded data. The EEPROM 10 is an element for storing the image compensation signals or storing a separate data and is optionally used by the timing controller 20.

In one implementation, the driving circuit unit DC includes an EEPROM writer 15, that is, a memory writer, which is used for writing the image compensation signals to the EEPROM 10. That is, the EEPROM writer 15 is connected with the EEPROM 10 to write the image compensation signals in the EEPROM 10. After the image compensation signals a re completely wrote in the EEPROM 10, the EEPROM writer 15 may be removed.

The $I^2C$ bus 30 is used as an interface between the timing controller 20 and the EEPROM 10, that is, a communicating mechanism therebetween. In this embodiment, in connecting between the timing controller 30 and the memory 10 using the $I^2C$ bus 30, a connection distance of the $I^2C$ bus 30 has a distance as short as possible. Accordingly, the connection distance of the $I^2C$ bus 30 is the minimum distance.

In one implementation, the EEPROM 10 and the EEPROM writer 15 may be connected through the $I^2C$ bus 30.

Figure 2:
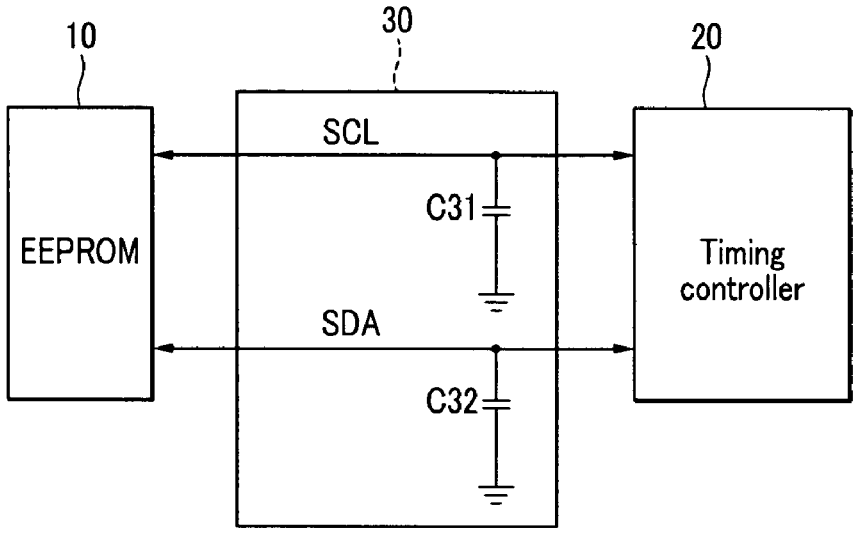
FIG. 2 is a block diagram illustrating an $I^2C$ bus between an electrically erasable and programmable read only memory (EEPROM) and a timing controller shown in FIG. 1.

FIG. 2 is a schematic circuit diagram of an I2C bus according to an exemplary embodiment of the present invention.

As shown in FIG. 2, the $I^2C$ bus 30 includes a serial clock line (SCL) and a serial data line (SDA) respectively having a first end part connected with the EEPROM 10 and a second end part connected with the timing controller 20, and capacitors C31 and C32 respectively connected to the serial clock line SCL and the serial data line SDA. For example, the decoupling capacitor connected to the serial clock line SCL is referred to as a first decoupling capacitor C31, and the decoupling capacitor connected to the serial data line SDL is referred to as a second decoupling capacitor C32. Also, the decoupling capacitors C31 and C32 are respectively connected to the serial clock line SCL and the serial data line SDA to be nearer to the timing controller 20 than the EEPROM 10.

Figure 3:
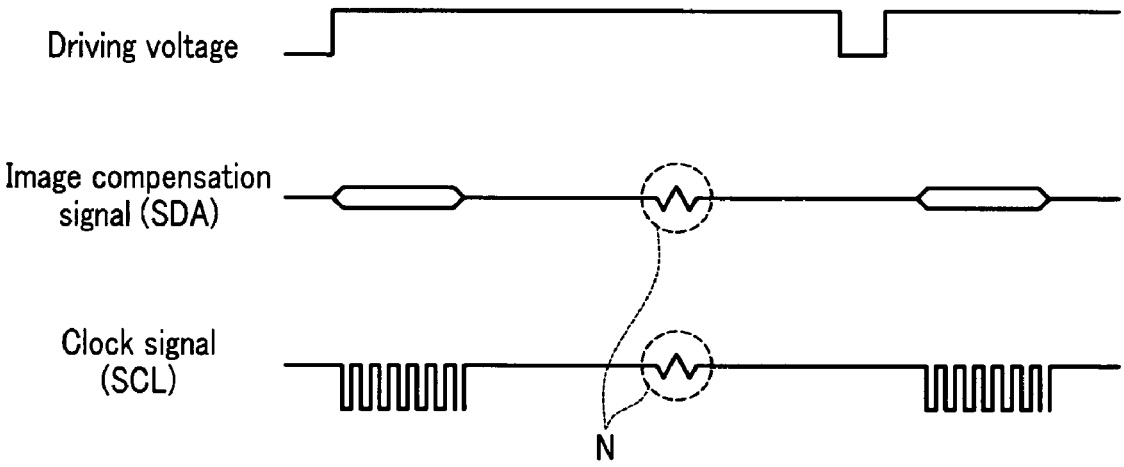
FIG. 3 is a waveform diagram of image compensation signals and a clock signal transmitted from an EEPROM to a timing controller when a driving voltage is applied to an EEPROM according to an exemplary embodiment of the present invention.

FIG. 3 is a waveform diagram of image compensation signals and a clock signal transmitted from an EEPROM to a timing controller when a driving voltage is applied to an EEPROM according to an exemplary embodiment of the present invention.

As shown in FIG. 3, when a driving voltage is applied to the $I^2C$ bus 30, image compensation signals are transmitted to the timing controller 20 from the EEPROM 10 through the serial data line SDA in synchronization with a clock signal. Referring to FIG. 3, the clock signal is transmitted to the timing controller 20 from the EEPROM 10 through the serial clock line SCL. Thereby, the timing controller 20 processes the input image signals RGB using the image compensation signals and so on to generate the image signals RGB'.

However, an unnecessary signal may be generated to the serial clock line SCL and the serial data line SDA due to electrostatic discharge (ESD), or external noise may enter the serial clock line SCL and the serial data line SDA. For example, the timing controller 20 may misunderstand the unnecessary (i.e., undesired) signal generated due to the electrostatic discharge and the noise as the clock signal and/or the image compensation signals, which may result in a malfunction. In one implementation, the quality of the image which the display device 100 displays may be deteriorated due to the malfunction of the timing controller 20. Hereinafter, the unnecessary signal generated due to the electrostatic discharge and the noise will be referred to as an electrostatic signal "N" for convenience.

However, since the connection distance of the $I^2C$ bus is the shortest as possible, the generation possibility of the electrostatic signal N decreases. Even though the electrostatic signal N is generated or input, the electrostatic signal N is removed by a filtering function of the decoupling capacitors C31 and C32 respectively connected to the serial clock line SCL and the serial data line SDA. In particular, since the decoupling capacitors C31 and C32 are connected to the serial clock line SCL and the serial data line SDA to be nearer to the timing controller 20, the decoupling capacitors C31 and C32 more effectively blocks that the electrostatic signal N is input to the timing controller 20.

Accordingly, the timing controller 20 may be prevented from misunderstanding the electrostatic signal N as the clock signal and the image compensation signals, thereby preventing the timing controller 20 from malfunctioning.

Figure 4:
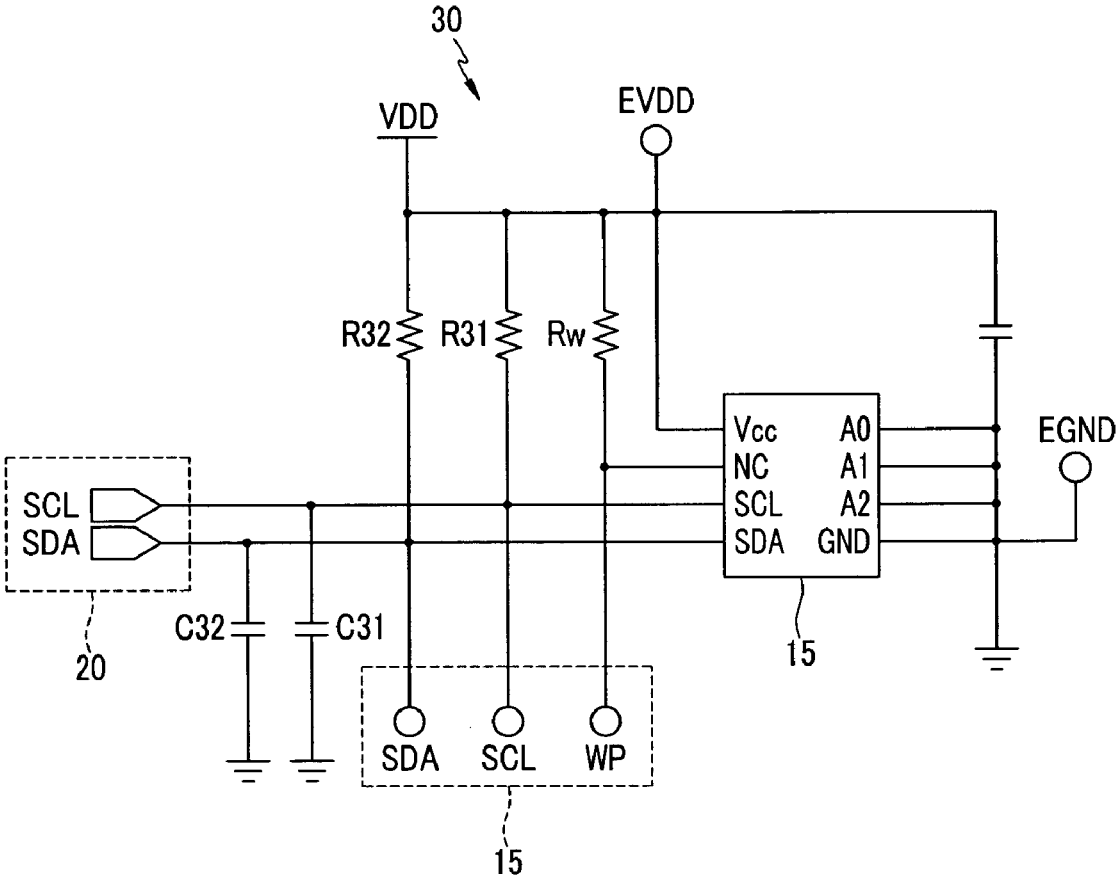
FIG. 4 is a detailed circuit diagram of a first example of an $I^2C$ according to an exemplary embodiment of the present invention.

FIG. 4 is a detailed circuit diagram of a first example of the $I^2C$ bus according to an exemplary embodiment of the present invention. As shown in FIG. 4, related to a circuit configuration, the $I^2C$ bus 30 includes the serial clock line SCL connected to a terminal SCL of the EEPROM 10, the serial data line SDA connected to a terminal SDA of the EEPROM 10, the first decoupling capacitor C31, the second decoupling capacitor C32, a driving power line VDD, a first pull up resistance R31, and a second pull up resistance R32. The driving power line VDD supplies a driving voltage to the $I^2C$ bus 30 and the EEPROM 10. A reference numeral EVDD refers to a line supplying the driving voltage to a terminal VCC of the EEPROM 10.

The first pull up resistance R31 is respectively connected with the driving power line VDD and the serial clock line SCL. In one implementation, the second pull up resistance R32 is respectively connected with the driving power line VDD and the serial data line SDA. That is, the first pull up resistance R31 is disposed between the driving power line VDD and the serial clock line SCL to maintain a high level of the serial clock line SCL depending on an open drain type driving of the EEPROM 10, and the second pull up resistance R32 is disposed between the driving power line VDD and the serial data line SDA to maintain a high level of the serial data line SDA.

Referring to FIG. 4, the EEPROM writer 15 is connected with the $I^2C$ bus 30 using connection terminals SDA and SCL. The EEPROM writer 15 is connected to the $I^2C$ bus 30 only when recording the image compensation signals in the EEPROM 10. After the image compensation signals are completely recorded in the EEPROM 10, the EEPROM writer 15 is electrically divided from the I2C bus 30, and the timing controller 20 reads the image compensation signals recorded in the EEPROM 10 through the I2C bus 30. F or example, the EEPROM writer 15 may be removed from the driving circuit unit DC after the image compensation signals are completely recorded in the EEPROM 10. In FIG. 4, a connection terminal WP is a terminal for directly connecting the EEPROM writer 15 to the EEPROM 10. Thereby, the EEPROM writer 15 may be directly connected with the EEPROM 10 to store desired data in the EEPROM 10 directly and not through the $I^2C$ bus 30.

In one implementation, as shown in FIG. 4, a record control resistor Rw connected with the EEPROM writer 15 and the EEPROM 10 is further provided. The record control resistor Rw is provided to stably supply a current to the EEPROM 10. Alternatively, the record control resistor Rw may be omitted.

As described above, the first end parts of the serial clock line SCL and the serial data line SDA are respectively connected with the EEPROM 10, and the second end parts thereof are respectively connected with the timing controller 20. As describe above referring to FIG. 3, the first decoupling capacitor C31 and the second decoupling capacitor C32 are respectively connected to the serial clock line SCL and the serial data line SDA to be nearer to the timing controller 20 than the EEPROM 10.

In FIG. 4, terminals A0-A2 that are not used and a terminal GND of the EEPROM 10 is a ground voltage, and the ground voltage may be applied through a terminal EGND from an external device.

Thereby, like the description referring FIG. 2, because of the connection distance of the $I^2C$ but 30, the decoupling capacitors C31 and C32, and the connection position of the capacitors C31 and C32, the electrostatic signal N is prevented from being mixed with the clock signal and the image compensation signals transmitted from the EEPROM 10 to the timing controller 20, thereby preventing the timing controller 20 from malfunctioning. That is, in one aspect, the electrostatic signal N is diminished so as to not be recognized by the timing controller 20. Accordingly, the timing controller 20 is prevented from misunderstanding the electrostatic signal N as the clock signal and the image compensation signals, and the timing controller 20 is prevented from malfunctioning. Accordingly, the display device 100 according to the present exemplary embodiment is prevent the quality of a displayed image from being deteriorated.

Hereinafter, a second example of an $I^2C$ bus 31 of an exemplary embodiment of the present invention will be described by referring to FIG. 5.

Figure 5:
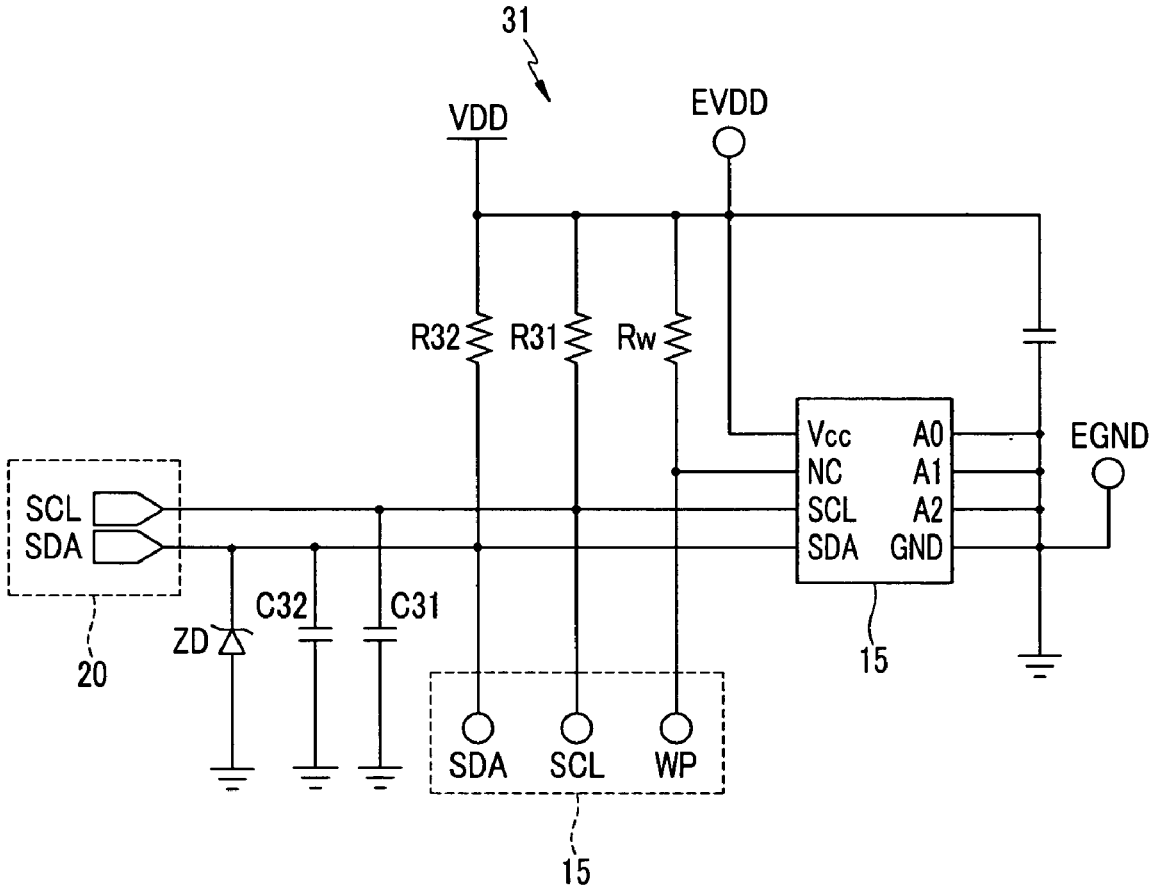
FIG. 5 is a detailed circuit diagram of a second example of an $I^2C$ according to an exemplary embodiment of the present invention.

FIG. 5 is a detailed circuit diagram of a second example of an $I^2C$ bus according to an exemplary embodiment of the present invention.

As compared with FIG. 3, the elements performing the same operations are indicated as the same reference numerals, and the detailed description thereof is omitted.

Referring to FIG. 5, a configuration of an $I^2C$ bus 31 according to the second example is similar to that of the I2C bus 30 shown in FIG. 3.

That is, the $I^2C$ bus 31 according to the second example includes a serial clock line SCL, a serial data line SDA, decoupling capacitors C31 and C32, a driving power line VDD, pull up resistors R31 and, and a record control resistor Rw.

However, different from FIG. 4, the $I^2C$ bus 31 of the example further includes a zener diode ZD connected between the serial data line SDA and a ground voltage. In particular, a cathode terminal of the zener diode ZD is connected with the serial data line SDA, and an anode terminal thereof is connected with the grounding voltage.

Like the capacitors C31 and C32, the zener diode ZD may be connected to the serial data line SDA to be nearer to the timing controller 20 than the EEPROM 10.In one implementation, the zener diode ZD maintains a constant voltage of the serial data line SDA. Accordingly, the zener diode ZD diminishes an electrostatic signal N mixed with the clock signal and the image compensation signals transmitted from the EEPROM 10 to a timing controller 20 together with the first decoupling capacitor C31 and the second decoupling capacitor C32. That is, the electrostatic signal N is more stably and efficiently diminished so as to not be recognized by the timing controller 20.

Accordingly, by the zener diode ZD as well as the connection distance of the $I^2C$ but 30, the decoupling capacitors C31 and C32, and the connection position of the capacitors C31 and C3, the timing controller 20 is more effectively prevented from misunderstanding the electrostatic signal N as the clock signal and the image compensation signals, and the timing controller 20 is prevented from malfunctioning. Accordingly, the display device 100 according to the present exemplary embodiment prevents the quality of a displayed image from being deteriorated.

Hereinafter, a third example of an $I^2C$ bus 32 according to an exemplary embodiment of the present invention will be described by referring to FIG. 6.

Figure 6:
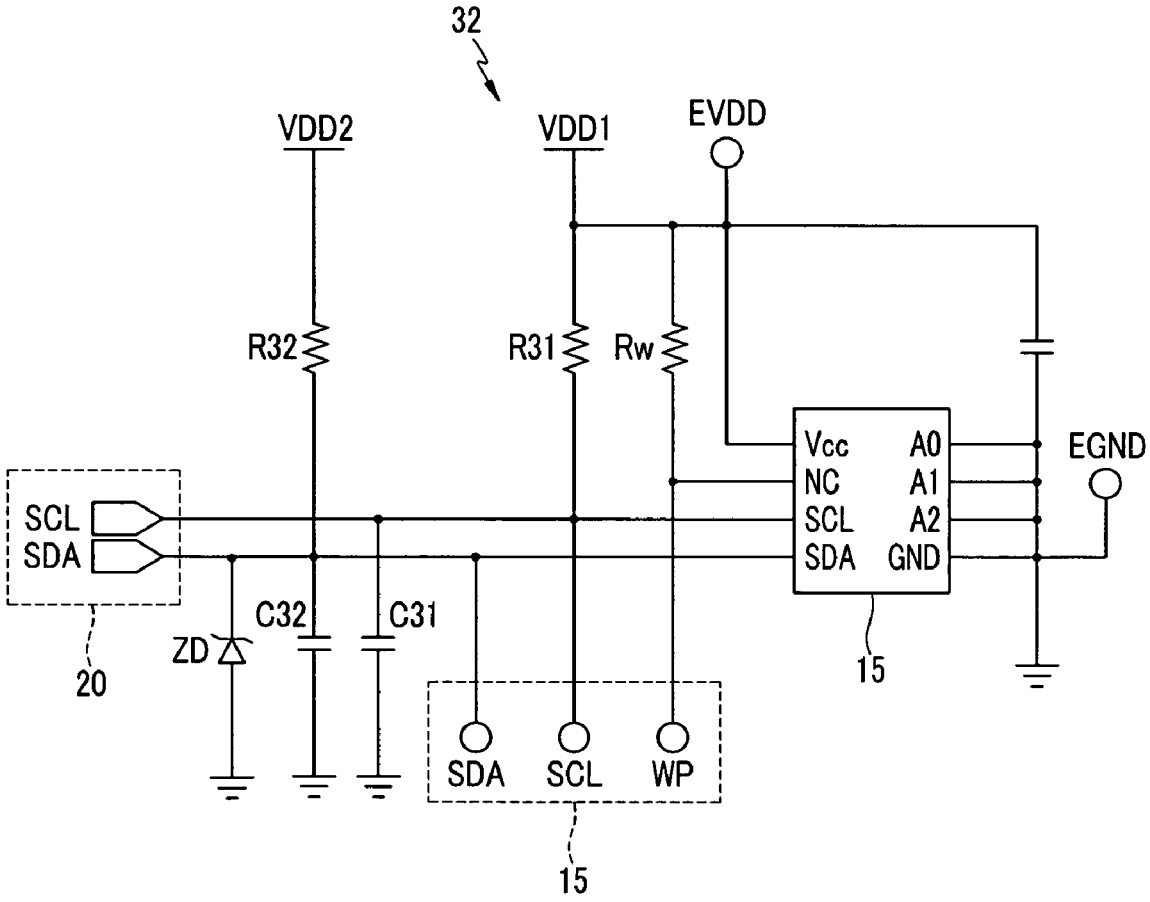
FIG. 6 is a detailed circuit diagram of a third example of an $I^2C$ according to an exemplary embodiment of the present invention.

FIG. 6 is a detailed circuit diagram of a third example of an $I^2C$ bus according to an exemplary embodiment of the present invention. As compared with FIG. 5, the elements performing the same operations are indicated as the same reference numerals, and the detailed description thereof is omitted.

Referring to FIG. 6, a configuration of the $I^2C$ bus 32 of this example includes a serial clock line SCL, a serial data line SDA, decoupling capacitors C31 and C32, first and second pull up resistors R31 and R32, a record control resistor Rw, and a zener diode ZD.

However, different from FIG. 5, the first pull up resistor R31 is connected to a first driving power line VDD1 and the serial clock line SCA, the second pull up resistor R31 is connected between a second driving power line VDD2 and the serial data line SDA, and the record control resistor Rw is connected between the first driving power line VDD1 and the EEPROM writer 15 and the EEPROM 10.

A driving voltage applied to the first driving power line VDD1 is different from that applied to the second driving power line VDD2, and thereby, the serial data line SDA is supplied with a driving voltage from the second driving power line VDD2 to be different from the serial clock line SCL.

For example, the zener diode ZD may be unnecessary.

In this example, the driving power lines supplying the driving voltages to the serial clock line SCL and the serial data line SDA are independently divided to more efficiently prevent an unnecessary signal from being generated to the serial clock line SCL and the serial data line SDA due to electrostatic discharge, and to more efficiently prevent an external noise from entering the serial clock line SCL and the serial data line SDA.

In one implementation, by the connection of the pull up resistors R31 and R32 and the driving power lines VDD1 and VDD2 described above, the first pull up resistor R31 maintains a high level of the serial clock line SCL depending on an open drain type driving of the EEPROM 10, and the second pull up resistor R32 maintains a high level of the serial data line SDA.

Accordingly, by the connection distance of the $I^2C$ but 30, the decoupling capacitors C31 and C32, the connection position of the capacitors C31 and C3, and the zener diode ZD, an electrostatic signal N is prevented from being mixed with the clock signal and the image compensation signals transmitted from the EEPROM 10 to a timing controller 20, thereby preventing the timing controller 20 from malfunctioning, In addition, the serial clock line SCL and the serial data line SDA are supplied with the different driving voltages through the driving power lines VDD1 and VDD2 independently divided from each other to prevent an unnecessary signal from being generated to the serial clock line SCL and the serial data line SDA due to electrostatic discharge, and to prevent an external noise from entering the serial clock line SCL and the serial data line SDA. That is, the electrostatic signal N is diminished so as to not be recognized by the timing controller 20. Accordingly, the timing controller 20 is further more effectively prevented from misunderstanding the electrostatic signal N as the clock signal and the image compensation signals, and the timing controller 20 is prevented from malfunctioning. Accordingly, the display device 100 according to the present exemplary embodiment is prevent the quality of a displayed image from being deteriorated.

As described in detail herein, the embodiments of the present invention provide a display device that prevents or at least reduces a timing controller from malfunctioning due to electrostatic discharge or external noise. That is, the display device according to various embodiments of the present invention reduces an effect which the electrostatic discharge or the external noise has on the timing controller through an interface between the timing controller and a memory to prevent the timing controller from malfunctioning, thereby preventing deterioration from being generated to the display device.

Although exemplary embodiments of the present disclosure have been shown and described, it will be appreciated by those skilled in the art that changes may be made to these exemplary embodiments without departing from the principles and spirit of the present disclosure, the scope of which is defined in the appended claims and their equivalents.

What is claimed is:

1. A display device comprising:

a timing controller that generates a control signal and a data signal for displaying an image;

a memory that records the data signal; and an $I^2C$ bus that connects the timing controller and the memory, wherein a connection distance of the interface between the timing controller and the memory has a minimum distance, wherein the $I^2C$ bus comprises:

a serial clock line and a serial data line, each respectively connected with the memory and the timing controller;

first and second capacitors with are respectively connected to the serial clock line and the serial data line;

a first pull up resistor that is connected with a first driving voltage and the serial clock line; and a second pull up resistor that is connected with a second driving voltage and the serial data line, and wherein the first driving voltage is different from the second driving voltage.

2. The display device of claim 1, wherein the first and second capacitors are respectively connected to the serial clock line and the serial data line nearer to the timing controller than the memory.

3. The display device of claim 1, wherein the $I^2C$ bus further comprises a zener diode that is connected to the serial data line.

4. The display device of claim 1, wherein the $I^2C$ bus further comprises a zener diode which is connected to the serial data line.

5. The display device of claim 4, wherein the zener diode comprises a cathode terminal that is connected with the serial data line, and an anode terminal that is connected with a grounding voltage.

6. The display device of claim 1, wherein the memory comprises an electrically erasable and programmable read only memory (EEPROM).

7. The display device of claim 1, further comprising a memory writer that stores the data signal in the memory.

8. A method comprising:

generating a control signal and a data signal for displaying an image with a timing controller;

connecting the timing controller to a memory with an $I^2C$ bus; and recording the data signal in the memory;

wherein the connecting the $I^2C$ bus comprises:

connecting first end parts, respectively, of a clock line and a data line with the memory element;

connecting second end parts, respectively, of the clock line and data line with the timing controller;

connecting first and second decoupling capacitors, respectively, to the clock line and the data line;

connecting a first pull up resistor with a first driving voltage and the clock line; and connecting a second pull up resistor with a second the driving voltage and the data line, the first driving voltage being different from the second driving voltage.

9. The method of claim 8, wherein the memory comprises an electrically erasable and programmable read only memory (EEPROM).

10. The method of claim 9, further comprising connecting a memory writer with the memory for storing the data signal in the memory.

11. The method of claim 8, wherein the first and second decoupling capacitors are respectively connected to the clock line and the data line nearer to the timing controller than the memory.

12. The method of claim 8, wherein the connecting the $I^2C$ bus further comprises connecting a zener diode to the data line.

13. The method of claim 8, wherein the zener diode comprises a cathode terminal that is connected with the data line, and an anode terminal that is connected with a grounding terminal.

* * * * *